US007258585B2

(12) United States Patent
Hughes et al.

(10) Patent No.: US 7,258,585 B2
(45) Date of Patent: Aug. 21, 2007

(54) DEVICE AND METHOD FOR LATCHING SEPARABLE INSULATED CONNECTORS

(75) Inventors: David C. Hughes, Rubicon, WI (US); Frank J. Muench, Waukesha, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/034,588

(22) Filed: Jan. 13, 2005

(65) Prior Publication Data

US 2006/0154507 A1 Jul. 13, 2006

(51) Int. Cl.
*H01R 11/22* (2006.01)

(52) U.S. Cl. ..... 439/848; 439/185; 439/921

(58) Field of Classification Search ..... 439/181, 439/185, 186, 187, 921, 349, 843, 851, 848
See application file for complete search history.

(56) References Cited

U.S. PATENT DOCUMENTS

| | | | | | |
|---|---|---|---|---|---|
| 278,346 | A | * | 5/1883 | Long | 439/846 |
| 2,944,241 | A | | 7/1960 | Londell, Jr. | |
| 3,161,451 | A | * | 12/1964 | Neidecker | 439/268 |
| 3,539,972 | A | * | 11/1970 | Silva et al. | 439/185 |
| 3,654,590 | A | * | 4/1972 | Brown | 439/185 |
| 3,725,846 | A | | 4/1973 | Strain | |
| 3,798,586 | A | * | 3/1974 | Huska | 439/263 |
| 3,945,699 | A | * | 3/1976 | Westrom | 439/38 |
| 4,088,383 | A | * | 5/1978 | Fischer et al. | 439/185 |
| 4,443,054 | A | | 4/1984 | Ezawa et al. | |
| 4,820,183 | A | | 4/1989 | Knapp et al. | |
| 5,025,121 | A | * | 6/1991 | Allen et al. | 200/275 |
| 5,468,164 | A | * | 11/1995 | Demissy | 439/843 |
| 5,846,093 | A | | 12/1998 | Muench et al. | |
| 5,857,862 | A | | 1/1999 | Muench et al. | |
| 6,744,255 | B1 | | 6/2004 | Steinbrecher et al. | |

FOREIGN PATENT DOCUMENTS

| | | | | |
|---|---|---|---|---|
| DE | 3110609 | * | 10/1982 | 439/346 |
| DE | 3521365 | C1 * | 2/1987 | 439/346 |
| FR | 2508729 | | 12/1982 | |
| GB | 105227 | | 2/1918 | |

OTHER PUBLICATIONS

Cooper Power Systems—Product Literature—OEM Equipment, 600 A 15 and 25 kV Class Deadbreak Apparatus Bushing (4 sheets), Jan. 1990.

Cooper Power Systems Product Literature—Deadbreak Apparatus Connectors, 600 A 15/25 kV Class PUSH-OP Insulated Standoff Bushing (2 sheets), Aug. 2002.

(Continued)

*Primary Examiner*—Tho D. Ta
(74) *Attorney, Agent, or Firm*—Foley & Lardner LLP

(57) ABSTRACT

A latching mechanism for joining separable insulated connectors employs a plurality of finger contacts to create an interference fit with an electrode probe of an elbow connector. The electrode probe enters a cylindrical grouping of the plurality of finger contacts and a projection causes an interference fit between the finger contacts and the electrode probe. The finger contacts latch the connectors together and require a removal force greater than the latching force required to latch the connectors. The latching mechanism provides a multi-point current path between an elbow connector and a power transmission or distribution apparatus and provides operator feedback to indicate the latching of the mechanism.

32 Claims, 3 Drawing Sheets

OTHER PUBLICATIONS

Application for United States Patent for a Power Connection Containing a Visible Break, (Fish & Richardson P.C.) (pending 2004).

International Search Report for PCT/US2006/000778, date of mailing May 3, 2006, 3 pages.

* cited by examiner

DEVICE AND METHOD FOR LATCHING SEPARABLE INSULATED CONNECTORS

BACKGROUND

The present invention relates generally to the field of separable insulated connectors. More particularly, this invention relates to enhancements in latching mechanisms for separable insulated connectors.

RELATED ART

Separable insulated connectors provide the interconnection between energy sources and energy distribution systems. Typically, energy distribution is made possible through a large voltage distribution system, which results in power distribution to homes, businesses, and industrial settings throughout a particular region. In most cases, the distribution of power begins at a power generation facility, such as a power plant. As the power leaves the power plant, it enters a transmission substation to be converted up to extremely high voltages for long-distance transmission, typically in the range of 150 kV to 750 kV. Then power is transmitted over high-voltage transmission lines and is later converted down to distribution voltages that will allow the power to be distributed over short distances more economically. The power is then reduced from the 7,200 volts, typically delivered over a distribution bus line to the 240 volts necessary for ordinary residential or commercial electrical service.

The electrical connectors typically involved in power distribution at the switchgear level, known as separable insulated connectors, typically consist of a male connector and a female connector. The mating of the male and female connectors are necessary to close the electrical circuit, for distribution of power to customers. The female connector is typically a shielding cap or an elbow connector that mates with a male connector. The male connector is generally a loadbreak bushing that typically has a first end adapted for receiving a female connector (e.g., an elbow connector or shielding cap) and a second end adapted for connecting to a bushing well stud. The first end of the male connector is an elongated cylindrical member with a flange on the rim of the member. The flange allows for an interference fit between the bushing and the mating elbow connector. The flange secures the bushing to a groove in the inner wall of the mating elbow connector. The interference fit and the flange-groove mechanism are typical mating methods for a male and female connector.

Positioned within the male and female connectors are female and male contacts, respectively. The male contact is typically an electrode probe. The female contact is typically a contact tube with a plurality of finger contacts, which mate with the electrode probe from the female connector. When the male and female contacts mate, the electrical circuit is closed.

The mating of most separable insulated connectors is typically accomplished by an interference-fit rubber latch mechanism to secure an elbow connector with a bushing. Typically, the latch mechanisms of the connectors are lubricated to prevent the connectors from bonding together. To avoid the inadvertent bonding, line-crew operators often over-lubricate the rubber fittings. Typically, these interference-fit latch mechanisms may become unlatched due to over lubrication of the latch ring geometry, which is referred to as the hydraulic effect.

Many separable insulated connectors provide a visual indicator band, of a contrasting color, for notification that an elbow connector is unlatched from a bushing. However, an elbow connector can subsequently become unlatched after it is connected with the bushing, due to the hydraulic effect between the elbow connector and the bushing. This occurrence can be the result of numerous factors, one factor being the low removal force typically required to unlatch mating connectors.

Accordingly, it would be advantageous to provide a latching Mechanism that exhibits a reduced probability of becoming inadvertently unlatched. Also, it would be advantageous to provide a latching mechanism that requires a force for removing the electrode probe to be greater than the force for latching the electrode probe. Additionally, it would be advantageous to provide a latching mechanism that produces audible notification of latching between the mating separable insulated connectors. It would be desirable to provide a latching mechanism or the like of a type disclosed in the present application that includes any one or more of these or other advantageous features. It should be appreciated, however, that the teachings herein may also be applied to achieve devices and methods that do not necessarily achieve any of the foregoing advantages but rather achieve different advantages.

SUMMARY

One exemplary embodiment pertains to a latching mechanism for a separable insulated connector. A latching mechanism, in accordance with an exemplary embodiment comprises an electrode probe and a plurality of finger contacts. The electrode probe includes one of either a recessed area or a projection, and a plurality of finger contacts includes the alternative one of the recessed area or the projection. The finger contacts and the electrode probe mate by latching the projection or projections into the recessed area.

In accordance with another exemplary embodiment, a mechanism and method comprise latching an electrode probe with a plurality of finger contacts, wherein the tip of the electrode probe penetrates into a cylindrical grouping of finger contacts. A projection in the latching mechanism causes an interference fit between the finger contacts and the electrode probe.

Still other advantages of the present invention will become readily apparent to those skilled in this art from review of the enclosed description, wherein the preferred embodiment of the invention is disclosed, simply by way of the best mode contemplated, of carrying out the invention. As it shall be understood, the invention is capable of other and different embodiments, and its several details are capable of modifications in various respects, all without departing from the invention. Accordingly, the figures and description shall be regarded as illustrative in nature, and not as restrictive.

DETAILED DESCRIPTION OF THE PREFERRED EMBODIMENTS

Figure 1:
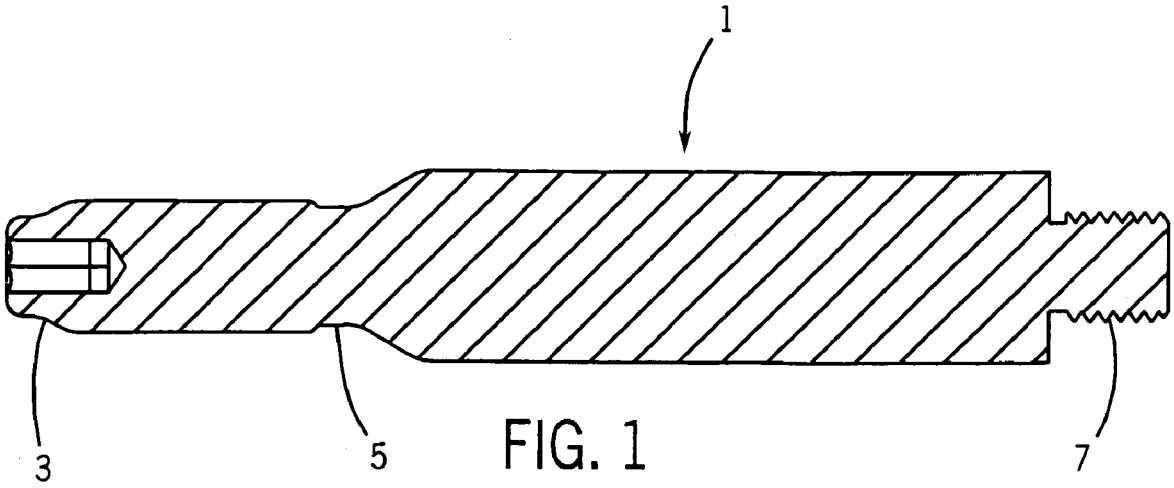
FIG. 1 is a cross-sectional view of an electrode probe with a recessed middle area and a recessed tip.

Referring to FIG. 1, electrode probe 1 is illustrated as a cylindrical member with recessed tip 3 near a first end of electrode probe 1, wherein the cylindrical member may be in the form of a rod or tube. In a circuit closing operation, recessed tip 3 is the first section of electrode probe 1 to connect with finger contacts 11 (shown in FIGS. 2 and 3). Recessed tip 3 is contoured to penetrate into the grouping of finger contacts 11 (shown in FIG. 5). Electrode probe 1 also has recessed area 5 near the middle of the cylindrical body of electrode probe 1. Recessed area 5 provides a contact point for interlocking electrode probe 1 with finger contacts 11 (shown in FIG. 5).

Threaded base 7 is positioned at a second end of the cylindrical body of electrode probe 1, opposite recessed tip 3 of electrode probe 1. Threaded base 7 is recessed from the general radius of electrode probe 1, and threaded base 7 provides electrode probe 1 with a connection to the power cable of an elbow connector.

Figure 2:
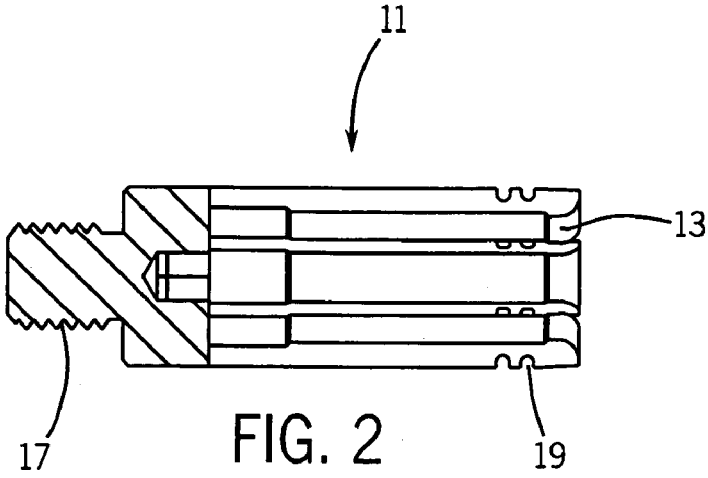
FIG. 2 is cross-sectional view of a cylindrical grouping of finger contacts with a plurality of recessed grooves on the external surface of each finger contact.

Referring now to FIG. 2, a plurality of finger contacts 11 is illustrated as a cylindrical grouping for mating with electrode probe 1. Each finger contact 11 has a projection 13 near a first end of each finger contact 11. Projection 13 is a protrusion on the inner surface of each finger contact 11 that provides a contact point for each finger contact 11 to interlock with recessed area 5 of electrode probe 1 when fully latched together. As electrode probe 1 is inserted into a plurality of finger contacts 11 during a loadbreak operation, electrode probe 1 slides into the grouping of finger contacts 11 by riding on projection 13 of each finger contact 11 (shown in FIG. 4). Projection 13 provides a reduced surface area over which electrode probe 1 must traverse in order to make full connection with the plurality of finger contacts 11.

Figure 3:
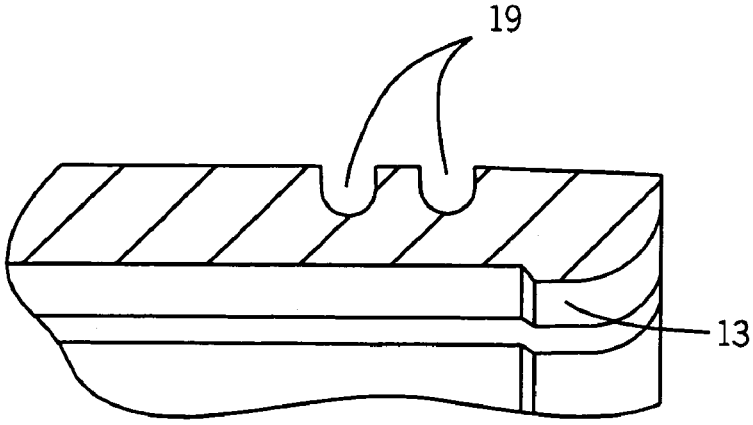
FIG. 3 is an enlarged cross-sectional view of a single finger contact exhibiting a plurality of recessed grooves in the external surface of the finger contact.

FIGS. 2 and 3 also illustrate a plurality of recessed grooves 19 on the external surface of each finger contact 11. Each recessed groove 19 is an indentation formed in the external surface of each finger contact 11. Each recessed groove 19 can house an expandable retention spring (shown in FIGS. 4, 5, and 6), for restricting the flexibility of finger contacts 11. FIG. 3 provides an enlarged illustration of recessed grooves 19 and projections 13 on a single finger contact 11. FIG. 2 also illustrates threaded base 17 positioned at the second end of finger contacts 11, opposite the plurality of projections 13 on finger contacts 11. Threaded base 17 is recessed from the general radius of the body of finger contacts 11, and threaded base 17 provides finger contacts 11 with a connection to bushing well stud of a switchgear.

Figure 4:
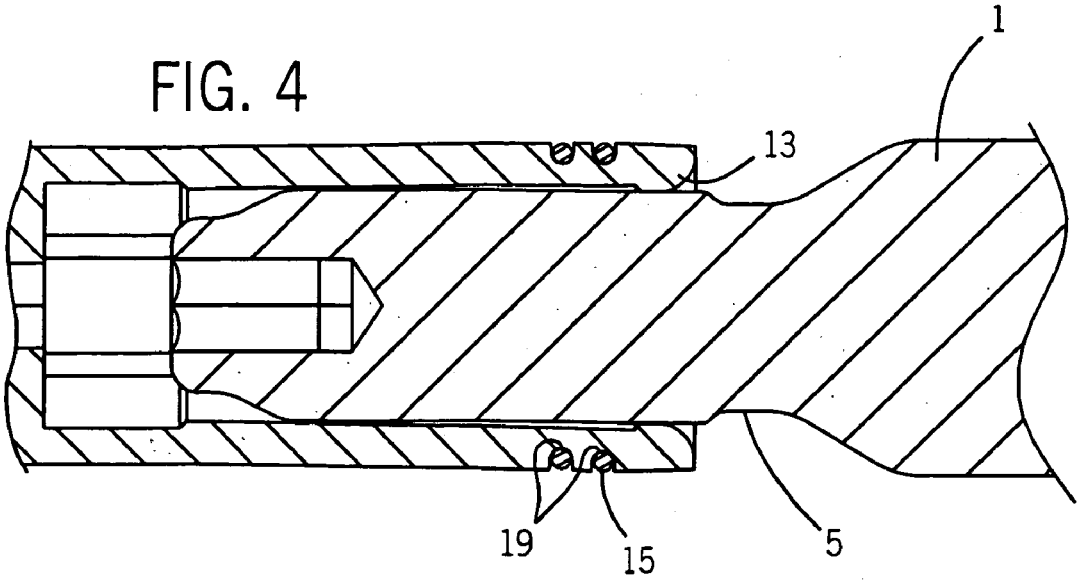
FIG. 4 is a cross-sectional view of a latching mechanism, with an electrode probe mating with finger contacts and the electrode probe riding on the projection of the finger contacts during the latching process.
Figure 5:
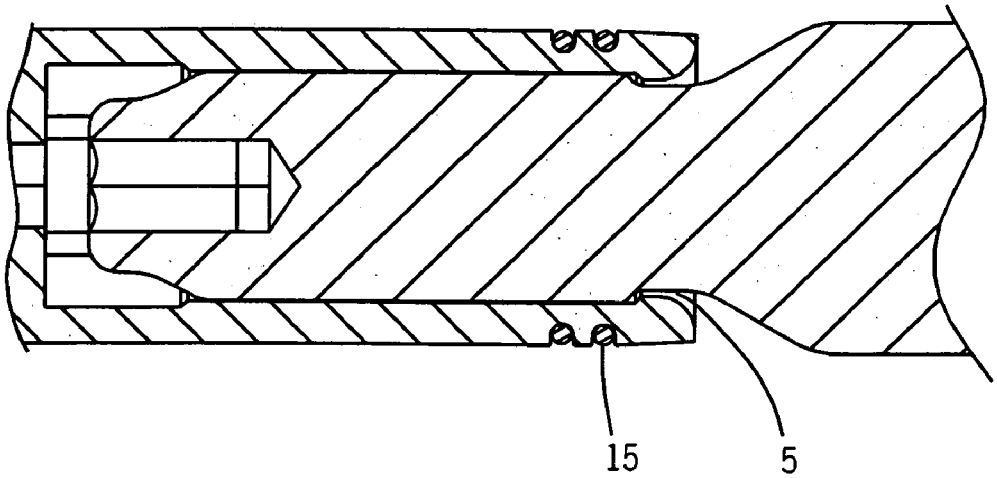
FIG. 5 is a cross-sectional view of the latching mechanism, with an electrode probe and finger contacts latched together by the projections being seated in a recessed area of the electrode probe.

FIGS. 4 and 5 illustrate the penetrating and latching of electrode probe 1 into finger contacts 11. As shown in FIG. 4, electrode probe 1 penetrates into the plurality of finger contacts 11 and slides into the central common area of finger contacts 11 by riding on the plurality of projections 13. The plurality of projections 13 allows electrode probe 1 to slide into finger contacts 11, requiring a reduced amount of force and friction for inserting electrode probe 1 into finger contacts 11. Each projection 13 is formed with a rounded face and a backside comprising a ridge angled steeper than the rounded face on the front-side of projection 13. The ridge of projection 13 is sloped closer to perpendicular to the axis of motion of electrode probe 1 than the rounded face of projection 13. The rounded face of projection 13 allows electrode probe 1 to slide into the plurality of finger contacts 11 with minimal resistance and reduced friction. As recessed tip 3 of electrode probe 1 converges with the rounded face of projection 13, recessed tip 3 glides into finger contacts 11 due to the minimal friction with the rounded face of projection 13. Conversely, the backside of projection 13 comprises a ridge for latching electrode probe 1 into finger contacts 11. Upon seating of electrode probe 1 within finger contacts 11, the ridge of projection 13 locks into recessed area 5. The ridge of projection 13 comprises a steeper angle than the rounded face on the front-side of projection 13, which results in requiring a greater removal force for electrode probe 1 from the plurality of finger contacts 11 than the required insertion force. The plurality of projections 13 allows the force required for latching a connector to be lower than the force required to unlatch the same connector.

Figure 6:
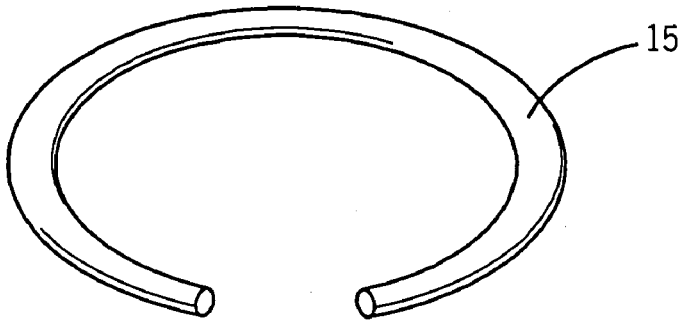
FIG. 6 is a three-dimensional view of a retention spring that can be seated in the recessed grooves of the finger contacts.

When electrode probe 1 is inserted into finger contacts 11, the grouping of finger contacts 11 expands outwardly due to the springiness of each finger contact 11. In order to increase the contact pressure of each finger contact 11, recessed grooves 19 on the external surface of each finger contact 11 house retention springs 15. FIG. 6 illustrates a retention spring 15 as a flexible, circular member, capable of expanding or contracting based on the applied force. Referring back to FIG. 4, as finger contacts 11 expand outwardly, retention spring 15 limits the resilience of each finger contact 11, thus making the structure more rigid.

Also, as shown in FIG. 4, electrode probe 1 touches each finger contact 11 primarily just on the surface of each projection 13, until each projection 13 reaches recessed area 5 of electrode probe 1. When each projection 13 is seated in recessed area 5 of electrode probe 1, electrode probe 1 is fully latched into the plurality of finger contacts 11. The mating of the electrode probe 1 and the plurality of finger contacts 11 produces an audible sound to denote latching of the mating interfaces. As electrode probe 1 rides on the surface of projection 13, finger contacts 11 are expanded outwardly due to the springiness of each finger contact 11. When the plurality of projections 13 reach recessed area 5, finger contacts 11 immediately contract from their expanded position. The contraction of finger contacts 11 snaps projections 13 into recessed area 5, thus creating an audible sound indicating that projections 13 are seated in recessed area 5. Electrode probe 1 is latched into finger contacts 11 when recessed area 5 and projections 13 make contact and are interlocked, as illustrated in FIG. 5. The audible sound may be an audible click, ring, or any audible notification loud enough to be heard by the unaided ear from a distance of at least four (4) feet, in order to indicate latching of the interfaces.

Figure 7:
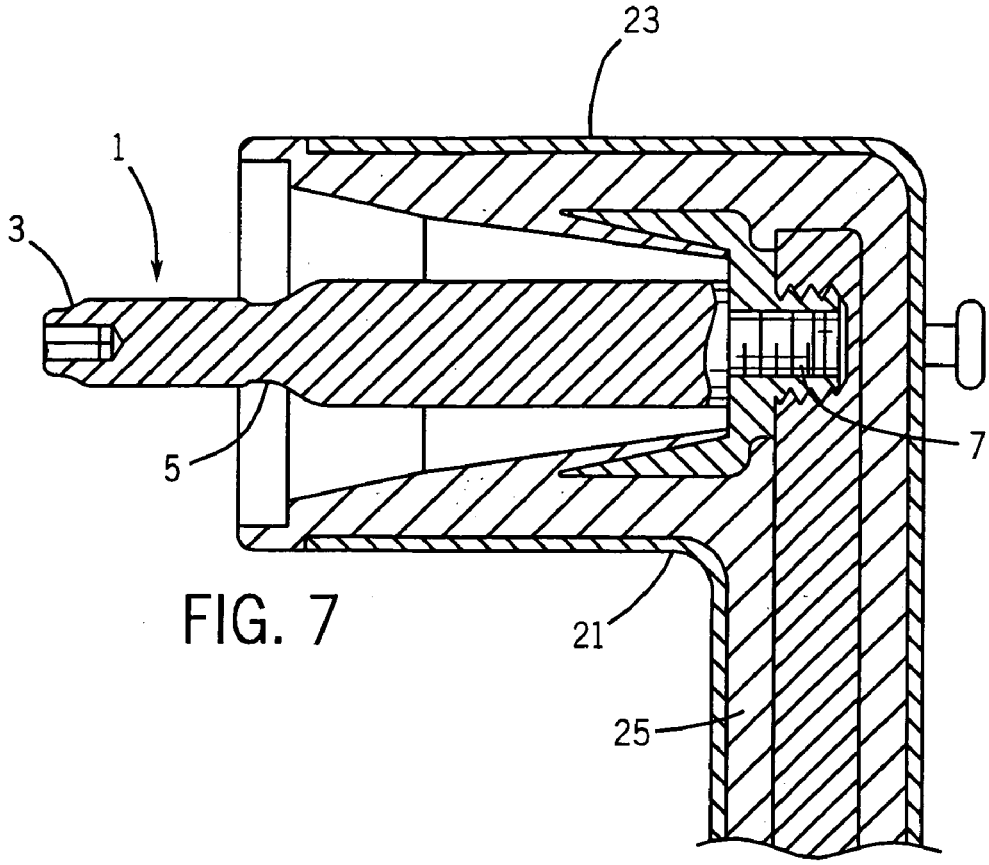
FIG. 7 is a cross-sectional view of an elbow connector with an electrode probe.

Referring to FIG. 7, elbow connector 21 is illustrated with electrode probe 1. Elbow connector 21 is housed in external insulated housing 23 and has an axial bore therethrough providing a hollow center for mating with bushing 31 (shown in FIG. 8). Insulated housing 33 is typically composed of a rubber compound; however, the housing is capable of other compositions. Insulated housing 33 provides a durable protective covering for electrode probe 1. Electrode probe 1 is positioned within elbow connector 21 and is secured in place by threaded base 7. Threaded base 7 provides electrode probe 1 with a connection to power cable 25 of elbow connector 21. FIG. 7 also illustrates recessed area 5 and recessed tip 3 (also shown in FIG. 1). Recessed tip 3 is curved in order to penetrate into a grouping of finger contacts 11, and recessed area 5 provides a contact point for latching electrode probe 1 with finger contacts 11 and also for conducting current between elbow connector 21 and a bushing well stud.

Figure 8:
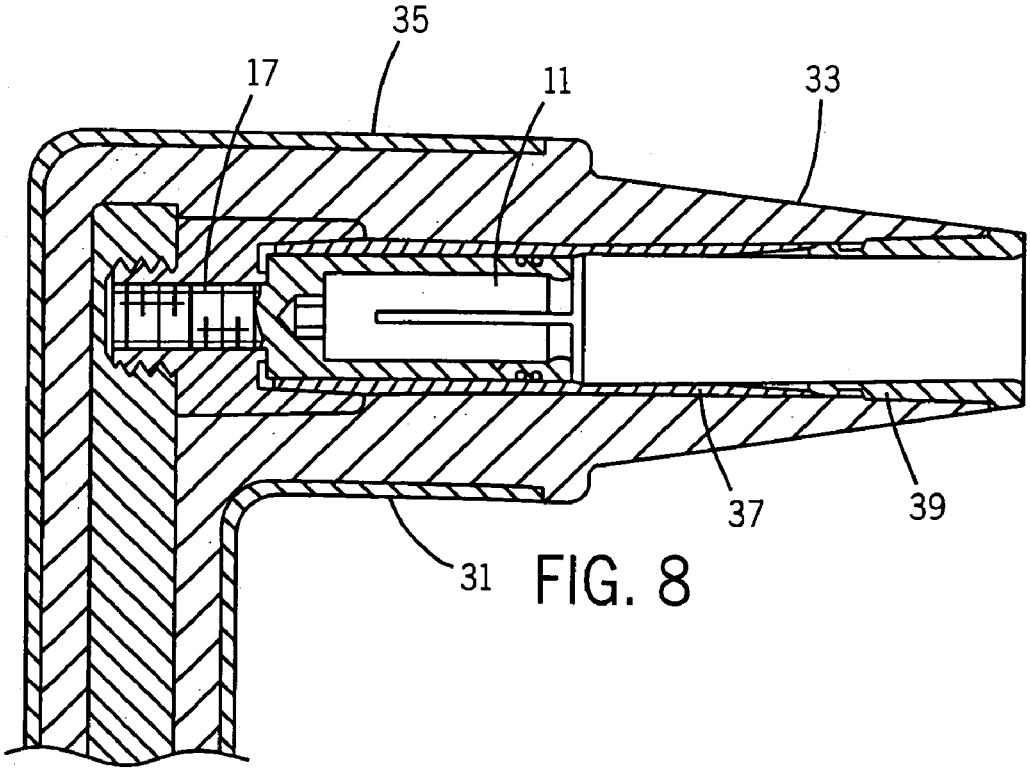
FIG. 8 is a cross-sectional view of a bushing with a grouping of finger contacts for mating with an electrode probe.

Referring to FIG. 8, bushing 31 is illustrated with a plurality of finger contacts positioned within. Bushing 31 is housed in insulated housing 33. Insulated housing 33 is also typically composed of a rubber compound; however, the housing is also capable of other compositions. Insulated housing 33 has a first and second end. The first end is an elongated cylindrical member for mating with elbow connector 21 and the second end is adapted for connecting to a bushing well stud.

The middle section of insulated housing 33, typically referred to as semi-conductive shield 35, is positioned between the first end and second end. The middle section is preferably comprised of a semi-conductive material that provides a deadfront safety shield. Positioned within the bore of insulated housing 33 is an internal conductive layer 37 layered close to the inner wall of insulated housing 33. Internal conductive layer 37 preferably extends from near both ends of insulated housing 33 to facilitate optimal current flow. Positioned within internal conductive layer 37 is internal insulative layer 39, which provides insulative protection to conductive layer 37.

Further positioned within the axial bore of bushing 31 are a plurality of finger contacts 11. Finger contacts 11 provide a multi-point current path between electrode probe 1 (shown in FIGS. 1, 4, 5, and 7) and a bushing well stud. When elbow connector 21 is mated with a bushing 31, electrode probe 1 enters into bushing 31, to connect with finger contacts 11 for continuous current flow. As shown in FIGS. 2, 3, and 4, each finger contact 11 has a projection 13 that allows electrode probe 1 to rest on while sliding into the central common area of finger contacts 11. Once electrode probe 1 has become completely seated within finger contacts 11, each projection 13 latches into recessed area 5 of electrode probe 1 (shown in FIG. 5). Also, threaded base 17 is positioned at the end of finger contacts 11, opposite projections 13. Threaded base 17 is recessed from the general radius of the body of finger contacts 11 and provides finger contacts 11 with a secure connection for current conductance to bushing 31.

Throughout the specification, numerous advantages of exemplary embodiments have been identified. It will be understood of course that it is possible to employ the teachings herein so as to without necessarily achieving the same advantages. Additionally, although many features have been described in the context of a power distribution system comprising multiple cables and connectors linked together, it will be appreciated that such features could also be implemented in the context of other hardware configurations. Further, although certain methods are described as a series of steps which are performed sequentially, the steps generally need not be performed in any particular order. Additionally, some steps shown may be performed repetitively with particular ones of the steps being performed more frequently than others, when applicable. Alternatively, it may be desirable in some situations to perform steps in a different order than described.

Many other changes and modifications may be made to the present invention without departing from the spirit thereof.

What is claimed is:

1. A latching mechanism for a high-voltage separable insulated connector, comprising:

a cylindrically-shaped electrode probe of an elbow connector, the electrode probe including one of either a recessed area or a projection; and a bushing including a plurality of finger contacts, the plurality of finger contacts being formed in a cylindrical grouping for receiving the electrode probe, wherein the plurality of finger contacts includes the other one of the recessed area or the projection, the projection having a rounded face for reduced friction when the electrode probe enters into the plurality of finger contacts and a backside comprising a ridge angled steeper than the slope of the rounded face of the projection for increased friction with the mating recessed area, such that the electrode probe and the plurality of finger contacts are configured to mate by latching the projection into the recessed area.

2. A latching mechanism according to claim 1, wherein the electrode probes has a recessed end for engaging with the plurality of finger contacts.

3. A latching mechanism according to claim 1, wherein the electrode probe is configured to transmit a voltage of at least 7.2 kilovolts (kV).

4. A latching mechanism according to claim 1, wherein the mating of the electrode probe and the plurality of finger contacts provides operator feedback indicating that the separable insulated connector is latched.

5. A latching mechanism according to claim 1, wherein the force required for removing the electrode probe is greater than the force required for latching the electrode probe to the plurality of finger contacts.

6. A latching mechanism according to claim 1, wherein the plurality of finger contacts have a series of projections along a first end of the plurality of finger contacts for latching into the recessed area of the electrode probe.

7. A latching mechanism according to claim 1, wherein the electrode probe is configured to be latched into the plurality of finger contacts with a live-line tool.

8. A latching mechanism according to claim 1, wherein the finger contacts comprise copper.

9. A latching mechanism according to claim 1, wherein the electrode probes has a recessed tip for engaging with the plurality of finger contacts, the electrode probe being configured to transmit a voltage of at least 7.2 kilovolts (kV), the plurality of finger contacts having a projection, such that the projection has a backside comprising a ridge angled steeper than the slope of the rounded face of the projection for increased friction with the mating recessed area.

10. A latching mechanism according to claim 1, wherein the plurality of finger contacts have a series of recessed grooves along the external surface of the plurality of finger contacts.

11. A latching mechanism according to claim 10, further comprising a plurality of retention springs seated in the recessed grooves on the external surface of the plurality of finger contacts for supporting the finger contacts.

12. A latching mechanism according to claim 11, wherein the retention springs provide increased pressure on the electrode probe by restricting the flexibility of the plurality of finger contacts.

13. A method comprising latching a cylindrically-shaped electrode probe of an elbow connector with a plurality of finger contacts in a high-voltage separable insulated connector, wherein, during the latching of the electrode probe and the plurality of finger contacts, the electrode probe enters a cylindrical grouping of the plurality of finger contacts and a projection causes an interference fit between the plurality of finger contacts and the electrode probe, the projection having a rounded face for reduced friction when the electrode probe enters into the plurality of finger contacts and a backside with a ridge angled steeper than the slope of the rounded face of the projection for increased friction with the mating recessed area.

14. A method according to claim 13 wherein, during the latching of the electrode probe and the plurality of finger contacts, the electrode probe rides on the surfaces of the projection to slide into the finger contacts.

15. A method according to claim 14 wherein, after the electrode probe rides on the surfaces of the projection, the projection latches into a recessed area.

16. A method according to claim 15, wherein the projection creates an interference fit between the finger contacts and the electrode probe and a resultant force is created such that the force required for removing the electrode probe is greater than the force required for latching the electrode probe to the plurality of finger contacts.

17. A method according to claim 13, wherein the electrode probe and plurality of finger contacts provide operator feedback indicating that the separable insulated connector is latched.

18. A method according to claim 17, wherein the operator feedback provided by the electrode probe and the plurality of finger contacts comprises an audible sound.

19. A system comprising:

a high-voltage power transmission or distribution apparatus;

an elbow connector, including a first insulated housing and a cylindrically-shaped electrode probe including one of either a recessed area or a projection; and a bushing, including a second insulated housing, a conductive layer, and a plurality of finger contacts being formed in a cylindrical grouping for receiving the electrode probe of the elbow connector, the finger contacts including the other one of the recessed area or the projection, wherein the finger contacts and the electrode probe are configured to mate by latching the projection into the recessed area, wherein the projection has a rounded face for reduced friction when the electrode probe enters into the plurality of finger contacts and has a backside comprising a ridge angled steeper than the slope of the rounded face of the projection for increased friction with the mating recessed area.

20. A system according to claim 19, wherein the mating of the elbow connector and the bushing provides operator feedback to indicate latching of the connectors.

21. A system according to claim 19, wherein the required removal force for the elbow connector is greater than the force for latching the elbow connector to the bushing.

22. A system according to claim 19, wherein the plurality of finger contacts have a series of projections along a first end of the plurality of finger contacts for latching into the recessed area of the electrode probe.

23. A system according to claim 19, wherein the elbow connector is configured to be latched into the bushing with the use of a live-line tool.

24. A system according to claim 19, wherein the finger contacts of the bushing comprise copper.

25. A system according to claim 19, wherein the plurality of finger contacts have a series of recessed grooves on the external surface of the plurality of finger contacts.

26. A system according to claim 25, further comprising a plurality of retention springs seated in the recessed grooves on the external surface of the plurality of finger contacts for supporting the finger contacts.

27. A system according to claim 26, wherein the retention springs provide increased pressure on the electrode probe by restricting the flexibility of the finger contacts.

28. A latching mechanism for a high-voltage separable insulated connector, comprising a bushing having a plurality of finger contacts, the bushing being capable of transmitting voltages of at least 7.2 kilovolts (kV), the plurality of finger contacts being formed in a cylindrical grouping, wherein the plurality of finger contacts includes one of either a recessed area or a projection, the bushing being configured to receive an electrode probe of a mating separable insulated connector having the other one of either the recessed area or the projection, the plurality of finger contacts being configured to latch by interlocking the projection into the recessed area, the protection has a rounded face for reduced friction when the electrode probe enters into the plurality of finger contacts and a backside comprising a ridge angled steeper than the slope of the rounded face of the projection for increased friction with the mating recessed area.

29. A latching mechanism according to claim 28, wherein the mating of the electrode probe and the plurality of finger contacts provides operator feedback indicating that the separable insulated connector is latched.

30. A latching mechanism according to claim 29, wherein the operator feedback provided by mating the electrode probe and the plurality of finger contacts comprises an audible sound capable of being heard by the unaided human ear from a distance of at least four (4) feet.

31. A latching mechanism for a high-voltage separable insulated connector, comprising a bushing having a plurality of finger contacts, the bushing being capable of transmitting voltages of at least 7.2 kilovolts (kV), the plurality of finger contacts being formed in a cylindrical grouping, wherein the plurality of finger contacts includes one of either a recessed area or a projection, the bushing being configured to receive an electrode probe of a mating separable insulated connector having the other one of either the recessed area or the projection, the projection having a rounded face for reduced friction when the electrode probe enters into the plurality of finger contacts and a backside comprising a ridge angled steeper than the slope of the rounded face of the projection for increased friction with the mating recessed area, the plurality of finger contacts being configured to latch by interlocking the projection into the recessed area, such that the latching provides audible operator feedback indicating that the separable insulated connector is latched, wherein the audible operator feedback is capable of being heard by the unaided human ear from a distance of at least four (4) feet.

32. A latching mechanism for a high-voltage separable insulated connector, comprising:

a cylindrically-shaped electrode probe of an elbow connector, the electrode probe including one of either a recessed area or a projection; and a bushing including a plurality of finger contacts, the plurality of finger contacts being formed in a cylindrical grouping for receiving the electrode probe, wherein the plurality of finger contacts includes the other one of the recessed area or the projection, the projection having a rounded face for reduced friction when the electrode probe enters into the plurality of finger contacts and a backside with a ridge angled steeper than the slope of the rounded face of the projection for increased friction with the mating recessed area, such that the electrode probe and the plurality of finger contacts are configured to mate by latching the projection into the recessed area.

* * * * *